US011975244B1

(12) United States Patent
Liu

(10) Patent No.: US 11,975,244 B1
(45) Date of Patent: May 7, 2024

(54) GLOWING GOLF BALL

(71) Applicant: GUAN DAI TECHNOLOGY COMPANY LTD., Tainan (TW)

(72) Inventor: Hung-Chih Liu, Tainan (TW)

(73) Assignee: Guan Dai Technology Company Ltd., Tainan (TW)

( * ) Notice: Subject to any disclaimer, the term of this patent is extended or adjusted under 35 U.S.C. 154(b) by 0 days.

(21) Appl. No.: 18/060,016

(22) Filed: Nov. 30, 2022

(51) Int. Cl.
*A63B 43/06* (2006.01)

(52) U.S. Cl.
CPC ..... *A63B 43/06* (2013.01); *A63B 2225/74* (2020.08)

(58) Field of Classification Search
CPC ..... A63B 43/06; A63B 2225/74
See application file for complete search history.

(56) References Cited

U.S. PATENT DOCUMENTS 3,229,976 A * 1/1966 Allen, Jr. ..... A63B 43/06 362/253
4,002,893 A * 1/1977 Newcomb ..... A63B 43/06 446/438
4,133,528 A * 1/1979 Koblick ..... A63B 43/06 446/485
4,957,297 A * 9/1990 Newcomb ..... A63B 37/0083 473/409
5,066,012 A * 11/1991 Stark ..... A63B 43/06 362/369
5,316,293 A * 5/1994 Hamilton ..... A63B 43/06 446/485
5,609,411 A * 3/1997 Wang ..... A63B 43/06 362/253
5,669,702 A * 9/1997 Wang ..... F21V 3/023 446/485
6,257,995 B1 * 7/2001 Schrimmer ..... A63B 43/06 473/353
8,663,040 B2 * 3/2014 Kortegast ..... A63B 43/06 473/570
8,727,919 B1 * 5/2014 Gentile ..... A63B 43/06 473/570
11,266,883 B2 * 3/2022 Ianni ..... A63B 43/004
2003/0224885 A1 * 12/2003 Leal ..... A63B 43/06 473/570

(Continued)

FOREIGN PATENT DOCUMENTS

CA 2880213 A1 * 8/2015 ..... A63B 37/0003
GB 2242364 A * 10/1991 ..... A63B 43/06

(Continued)

*Primary Examiner* — Steven B Wong
(74) *Attorney, Agent, or Firm* — Rosenberg, Klein & Lee

(57) ABSTRACT

A glowing golf ball is provided. A mounting hole is mounted in a light permeable ball and a light emitting member is mounted in the mounting hole. The light emitting member consists of a tube, a light emitting cap, a miniature battery, and a tube base. The tube is provided with a mounting room for mounting the light emitting cap. A light source is disposed on the light emitting cap and the miniature battery is fixed on the tube base. When the tube base and the tube are covered and fixed by each other, the miniature battery and the light source of the light emitting cap are electrically connected. Thus the light source emits light for allowing golf players to see flight paths and final landing positions of the golf ball in a more eye-catching way under poor light condition.

4 Claims, 5 Drawing Sheets

(56) References Cited

U.S. PATENT DOCUMENTS

| | | | | |
|---|---|---|---|---|
| 2007/0021244 | A1* | 1/2007 | Ko | A63B 41/00 473/570 |
| 2007/0281811 | A1* | 12/2007 | Wang | A63B 43/06 473/570 |
| 2015/0072810 | A1* | 3/2015 | Kortegast | A63B 43/06 362/184 |
| 2015/0159858 | A1* | 6/2015 | Lin | F21K 9/61 362/311.01 |
| 2016/0243410 | A1* | 8/2016 | Larson | A63B 41/085 |
| 2016/0354646 | A1* | 12/2016 | Wang | A63B 43/06 |
| 2017/0065856 | A1* | 3/2017 | Lin | A63B 69/0002 |
| 2023/0201672 | A1* | 6/2023 | You | A63B 39/08 473/570 |

FOREIGN PATENT DOCUMENTS

| | | | | |
|---|---|---|---|---|
| KR | 20080067759 | A * | 7/2008 | |
| KR | 483907 | Y1 * | 7/2017 | A63B 37/0001 |
| TW | 580992 | U * | 7/2019 | |

* cited by examiner

GLOWING GOLF BALL

BACKGROUND OF THE INVENTION

Field of the Invention

The present invention relates to a golf ball, especially to a glowing golf ball.

Description of Related Art

Playing golf is not only for exercising bodies, but also for entertainment. It can also be a social activity for business communication.

After being hit, a golf ball flies fast at high speed. It is difficult for golf players to get flight patterns and landing points of the golf ball once visibility is poor or a color of the golf ball is similar to that of the environment. It's more difficult to find the golf ball after the golf ball lands in bushes or on grasses because of shade the bushes or grasses create.

Thus there is room for improvement and there is a need to provide a novel golf ball which addresses issues of tracking golf shots, flight patterns, landing points, etc.

SUMMARY OF THE INVENTION

Therefore, it is a primary object of the present invention to provide a glowing golf ball which is able to emit light for allowing users to see a trajectory and a landing spot of a golf ball more clearly while the golf ball is hit in poor light condition.

In order to achieve the above object, a glowing golf ball according to the present invention includes a ball provided with a mounting hole formed therein and a light emitting member mounted in the mounting hole.

The light emitting member consists of a tube with light transmittance, a light emitting cap, a miniature battery, and a tube base. The tube is provided with a mounting room formed therein and used for mounting and fixing the light emitting cap. A light source is disposed on the light emitting cap and composed of two pins which are protruded from an inner surface of the light emitting cap and exposed. The miniature battery is fixed on the tube base. When the tube base and the tube are covered and fixed with each other, two electrodes of the miniature battery are electrically connected with the two pins of the light source correspondingly for conducting electrical power. Thereby the miniature battery provides power to the light source for making the light source emit light.

Preferably, the ball is light permeable.

Preferably, the light emitting cap has color.

A glowing golf ball according to the present invention has the following advantages.

After the tube base and the tube covered and fixed by each other, the two electrodes of the miniature battery are electrically connected with the two pins of the light source of the light emitting cap in the tube correspondingly for conducting electrical power. Thereby the light source emits light and the light emitted from the light source is eye-catching for allowing golf players to track golf shots, golf ball trajectory, and final landing position.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

In order to learn technical content, purposes and functions of the present invention more clearly and completely, please refer to the following detailed descriptions with the figures and reference signs.

Figure 1:
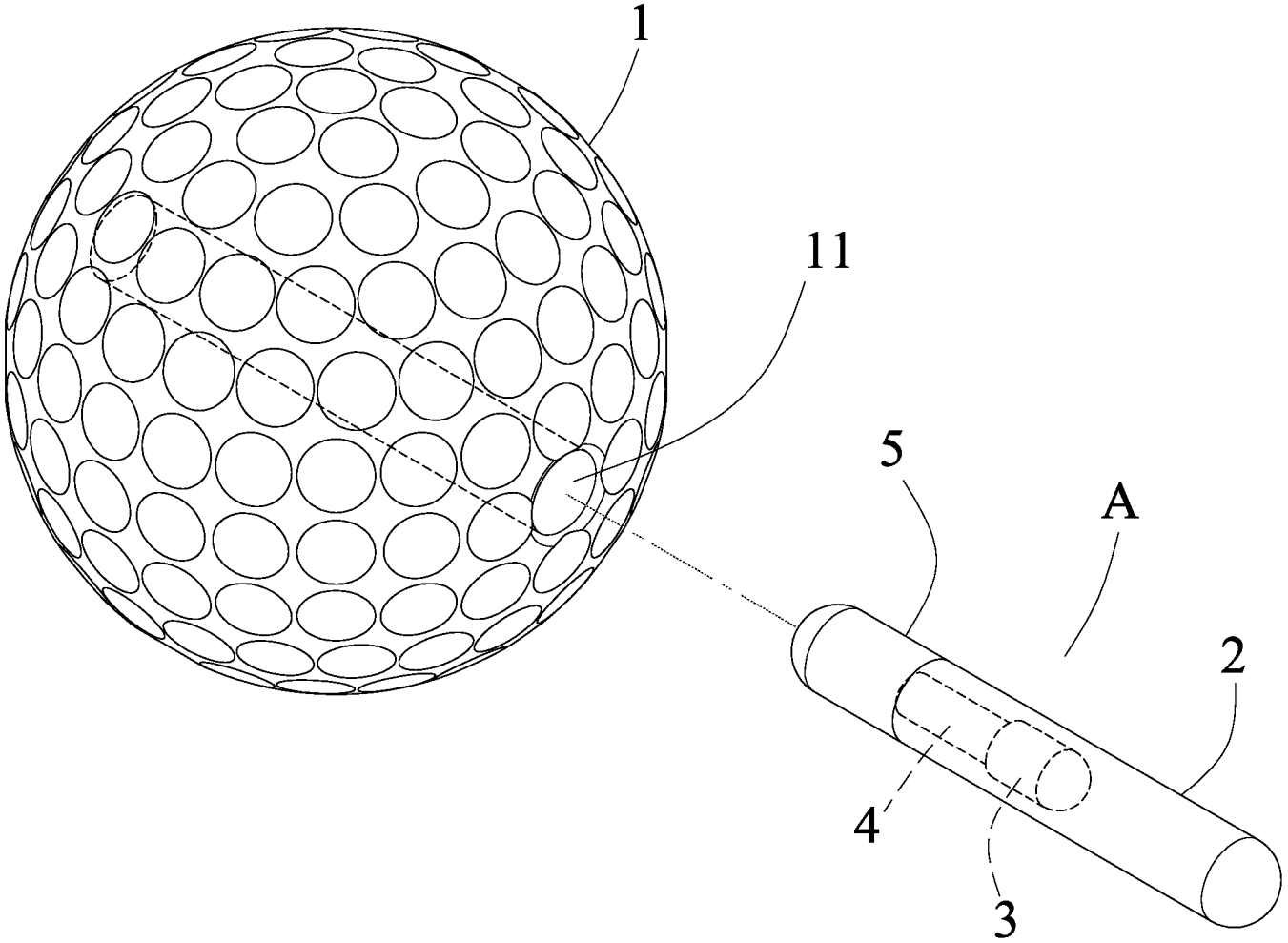
FIG. 1 is an exploded view of an embodiment according to the present invention.
Figure 2:
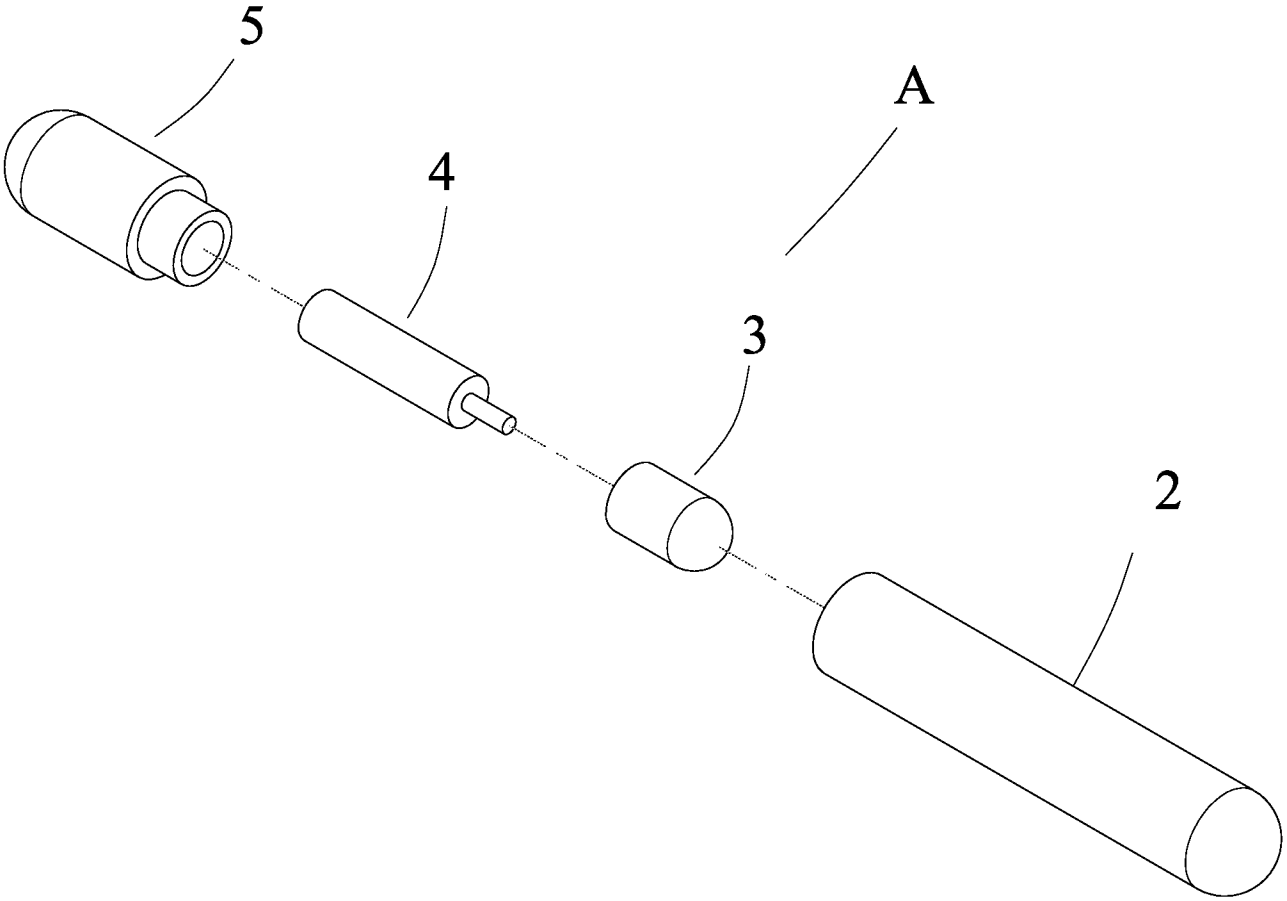
FIG. 2 is an exploded view of a light emitting member of an embodiment according to the present invention.

Refer to FIG. 1 and FIG. 2. A glowing golf ball according to the present invention mainly includes a ball 1 provided with a mounting hole 11 formed therein and a light emitting member A mounted in the mounting hole 11 extending from an open end in the outer surface of the ball.

Figure 3:
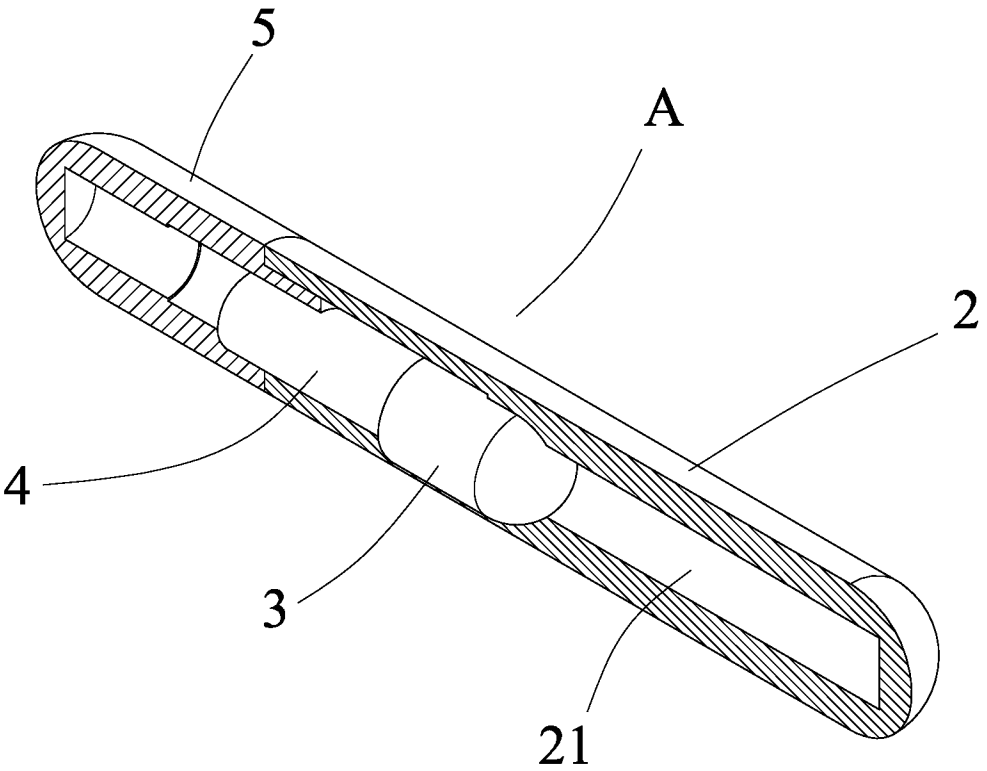
FIG. 3 is a schematic drawing showing a perspective sectional view of an embodiment according to the present invention.

Refer to FIG. 2 and FIG. 3, the light emitting member A consists of a tube 2 with light transmittance, a light emitting cap 3, a miniature battery 4, and a tube base 5.

The tube 2 is provided with a mounting room 21 therein for mounting and fixing the light emitting cap 3.

Figure 4:
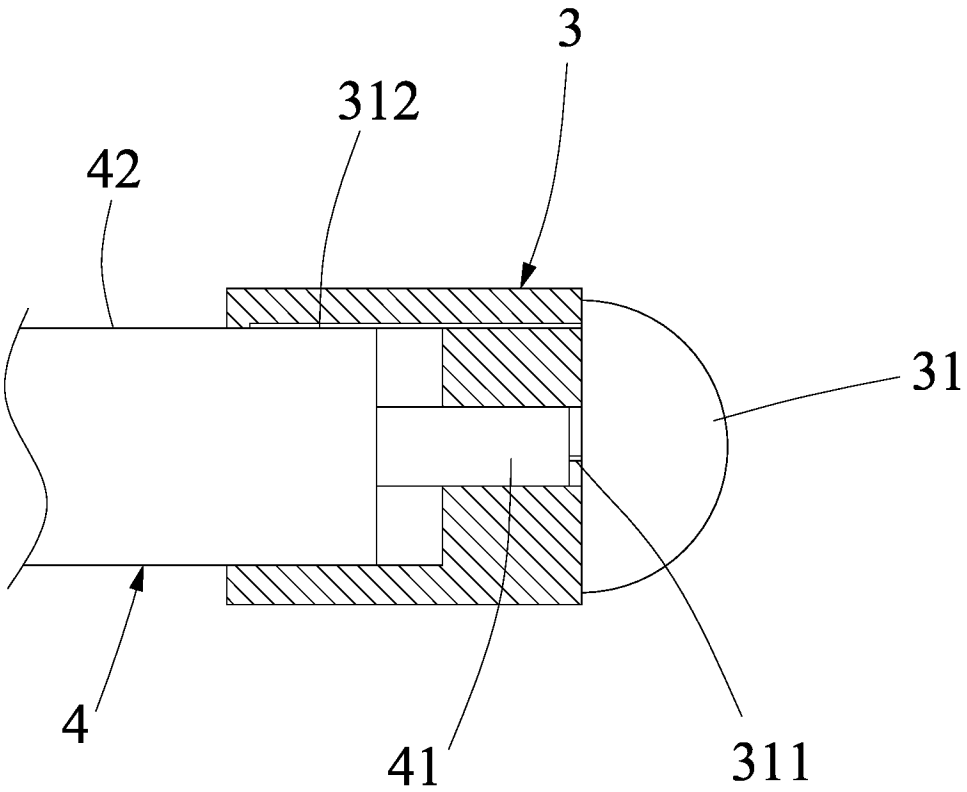
FIG. 4 is a partial sectional view showing a light emitting cap assembled with a miniature battery in an embodiment according to the present invention.
Figure 5:
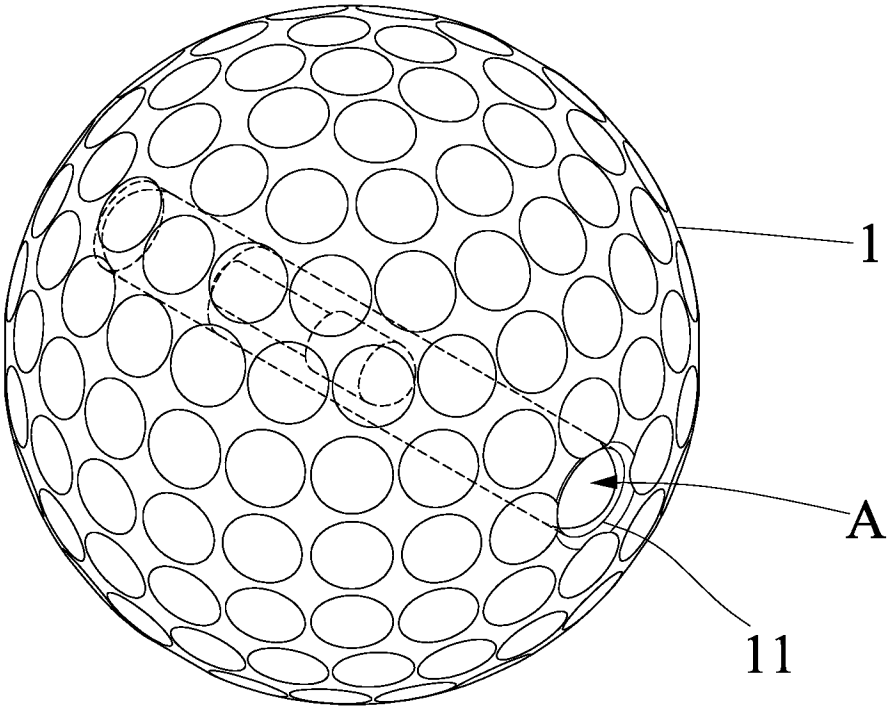
FIG. 5 is a schematic drawing showing an embodiment after assembly according to the present invention.

Also refer to FIG. 4, a light source 31 is arranged at the light emitting cap 3 and composed of two pins 311, 312 which are protruded from an inner surface of the light emitting cap 3 and exposed.

The miniature battery 4 is composed of a positive electrode end 41 and a negative electrode end 42 which are in contact with and electrically connected with the two pins 311, 312 of the light source 31 correspondingly for conducting electrical powder. The miniature battery 4 is fixed on the tube base 5.

The tube base 5 which is used for disposition of the miniature battery 4 is covered and fixed by the tube 2.

In a preferred embodiment, the ball 1 has light transmittance so that light emitted from the light emitting member A can travel through the ball 1. Moreover, the light emitting cap 3 used has color and the color corresponds to the light emitted from the light emitting member A.

While being assembled (as shown in FIG. 2-5), the light emitting cap 3 provided with the light source 31 is mounted into the mounting room 21 of the tube 2. Then a lower portion of the miniature battery 4 is mounted and fixed into the tube base 5 and an upper portion of the miniature battery 4 is mounted into the light emitting cap 3. Later the tube base 5 is covered and fixed by the tube 2. Thereby the tube 2, the light emitting cap 3, the miniature battery 4, and the tube base 5 are connected to form one part which is the light emitting member A. Next the light emitting member A is placed into the mounting hole 11 of the ball 1 and fixed therein. Owing to electrical connection and conduction between the positive and negative electrode ends 41, 42 of the miniature battery 4 and the two pins 311, 312 of the light source 31, power is supplied from the miniature battery 4 to the light source 31 so that light is emitted from the light source 31.

After the golf ball is struck, a golf player can see a trajectory and final landing position of the golf ball easily in a more eye-catching way due to light emitted from the light source 31.

When the miniature battery 4 in the light emitting member A is run out of power, the light emitting member A is removed by tools and a new light emitting member A is mounted into the mounting hole 11 of the ball 1. Thereby the ball 1 of the glowing golf ball can be used repeatedly, without wasting resources.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A glowing golf ball, comprising;

a ball having a mounting hole formed through an outer surface of the ball and extending into an interior thereof, the mounting hole extending from an open end in the outer surface of the ball; and a light emitting member removably mounted in the mounting hole through the open end thereof, the light emitting member including a tube with light transmittance, a light emitting cap, a miniature battery, and a tube base; wherein the tube is provided with a mounting room therein for mounting and fixing the light emitting cap;

wherein a light source is arranged at the light emitting cap and composed of two pins which are protruded from an inner surface of the light emitting cap and exposed; wherein the miniature battery is fixed on the tube base and provided with two electrodes electrically connected with the two pins of the light source, and the tube base and the tube are fixedly joined one to another; wherein the miniature battery provides power to the light source and light is emitted from the light source;

wherein one end of the light tube is positioned to be juxtaposed with the open end of the mounting hole, and wherein the light source is positioned proximate to the one end of the light tube, thereby the light source projects light via the light emitting member through at least the open end of the mounting hole.

2. The glowing golf ball as claimed in claim 1, wherein the light emitting cap has color.

3. The glowing golf ball as claimed in claim 1, wherein the ball is light permeable.

4. The glowing golf ball as claimed in claim 3, wherein the light emitting cap has color.

* * * * *